US009181610B2

(12) United States Patent
Mori et al.

(10) Patent No.: US 9,181,610 B2
(45) Date of Patent: Nov. 10, 2015

(54) AIR COOLING EQUIPMENT FOR HEAT TREATMENT PROCESS FOR MARTENSITIC STAINLESS STEEL PIPE OR TUBE

(75) Inventors: Nobuyuki Mori, Osaka (JP); Akihiro Sakamoto, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 984 days.

(21) Appl. No.: 12/934,241

(22) PCT Filed: Dec. 15, 2008

(86) PCT No.: PCT/JP2008/072734

§ 371 (c)(1),
(2), (4) Date: Nov. 4, 2010

(87) PCT Pub. No.: WO2009/118962

PCT Pub. Date: Oct. 1, 2009

(65) Prior Publication Data

US 2011/0120691 A1 May 26, 2011

(30) Foreign Application Priority Data

Mar. 27, 2008 (JP) ..... 2008-082781

(51) Int. Cl.
*C21D 9/08* (2006.01)
*F28F 7/00* (2006.01)
(Continued)

(52) U.S. Cl.
CPC . *C22C 38/18* (2013.01); *C21D 1/00* (2013.01); *C21D 9/08* (2013.01); *C21D 9/085* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS 1,984,771 A * 12/1934 Speller ..... 29/81.02
2,351,262 A * 6/1944 Hahn ..... 65/268
(Continued)

FOREIGN PATENT DOCUMENTS

JP 57-035630 2/1982
JP 3165918 A 7/1991
(Continued)

OTHER PUBLICATIONS

International Search Report in corresponding PCT/JP2008/072734 dated Mar. 3, 2009.

*Primary Examiner* — Gregory Huson
*Assistant Examiner* — Eric Gorman
(74) *Attorney, Agent, or Firm* — Marshall, Gerstein & Borun LLP

(57) ABSTRACT

An object of the present invention is to provide air cooling equipment for a heat treatment process for a martensitic stainless steel pipe, which is capable of shortening the time required for the heat treatment process by enhancing the cooling efficiency at the time when the inner surface of steel pipe is air cooled in the heat treatment ent process.
Air cooling equipment 100 for a heat treatment process for a martensitic stainless steel pipe P in accordance with the present invention comprises: a conveying device 10 for intermittently conveying the steel pipe P in the direction substantially at right angles to the longitudinal direction of the steel pipe P; and an air cooling device 20 provided with a nozzle 21 for spraying air Bi toward the inner surface of the steel pipe P, the nozzle 21 being arranged along the longitudinal direction of the steel pipe P at a stop position of the steel pipe P intermittently conveyed by the conveying device 10 so as to face to an end of the steel pipe P.

2 Claims, 3 Drawing Sheets

(51) Int. Cl.

| | |
|---|---|
| ***C21D 1/00*** | (2006.01) |
| ***C22C 38/00*** | (2006.01) |
| ***C22C 38/18*** | (2006.01) |
| ***C22C 38/54*** | (2006.01) |
| ***C21D 1/18*** | (2006.01) |
| ***F27D 9/00*** | (2006.01) |
| ***C22C 38/02*** | (2006.01) |
| ***C22C 38/04*** | (2006.01) |

(52) U.S. Cl.
CPC ..... *C22C 38/54* (2013.01); *C21D 2211/008* (2013.01)

(56) References Cited

U.S. PATENT DOCUMENTS

| | | | | | |
|---|---|---|---|---|---|
| 3,340,569 | A | * | 9/1967 | Hagen | 425/532 |
| 3,479,690 | A | * | 11/1969 | Hagen | 425/163 |
| 3,623,716 | A | * | 11/1971 | Fritsch et al. | 134/147 |
| 3,755,010 | A | * | 8/1973 | Moliterno | 148/570 |
| 3,932,094 | A | * | 1/1976 | Korff et al. | 425/393 |
| 4,090,841 | A | * | 5/1978 | Kramlehner | 432/60 |
| 4,116,716 | A | * | 9/1978 | Itoh et al. | 134/134 |
| 4,368,219 | A | * | 1/1983 | Nagata et al. | 427/236 |
| 4,376,528 | A | * | 3/1983 | Ohshimatani et al. | 266/114 |
| 4,424,855 | A | * | 1/1984 | Tsubakihara et al. | 164/485 |
| 4,444,376 | A | * | 4/1984 | Noguchi et al. | 266/117 |
| 4,461,462 | A | * | 7/1984 | Mizushima et al. | 266/117 |
| 4,490,187 | A | * | 12/1984 | Kruppert | 148/593 |
| 4,504,042 | A | * | 3/1985 | Kruppert | 266/115 |
| 4,803,037 | A | * | 2/1989 | McBain et al. | 266/78 |
| 5,094,013 | A | * | 3/1992 | Martin et al. | 34/62 |
| 5,200,124 | A | * | 4/1993 | Bowkett | 264/492 |
| 6,074,599 | A | * | 6/2000 | Murty et al. | 266/46 |
| 6,090,230 | A | * | 7/2000 | Okamura et al. | 148/590 |
| 6,378,605 | B1 | * | 4/2002 | Kutscher et al. | 165/181 |
| 6,394,793 | B1 | * | 5/2002 | Bunge | 432/85 |
| 6,421,931 | B1 | * | 7/2002 | Chapman | 34/424 |
| 6,514,340 | B1 | * | 2/2003 | Momose et al. | 118/58 |
| 8,119,074 | B2 | * | 2/2012 | Aguilar Elguezabal et al. | 422/150 |
| 2003/0066638 | A1 | * | 4/2003 | Qu et al. | 165/186 |
| 2003/0192686 | A1 | * | 10/2003 | Hisai et al. | 165/201 |
| 2006/0113011 | A1 | * | 6/2006 | Tanida et al. | 148/592 |
| 2006/0169375 | A1 | * | 8/2006 | Tanida | 148/605 |
| 2007/0001483 | A1 | * | 1/2007 | Uchida et al. | 296/187.12 |
| 2007/0246136 | A1 | * | 10/2007 | Mori | 148/592 |
| 2009/0033007 | A1 | * | 2/2009 | Tanida | 266/99 |
| 2010/0193086 | A1 | * | 8/2010 | Mori | 148/590 |
| 2010/0276848 | A1 | * | 11/2010 | Chen | 264/526 |
| 2014/0007994 | A1 | * | 1/2014 | Sakamoto et al. | 148/605 |

FOREIGN PATENT DOCUMENTS

| | | | | |
|---|---|---|---|---|
| JP | 03165918 | A | * | 7/1991 |
| JP | 8188827 | A | | 7/1996 |
| JP | 2002038219 | A | | 2/2002 |
| JP | 2002038219 | A | * | 2/2002 |
| JP | 2002038219 | A | | 2/2002 |
| WO | WO2005/035815 | A1 | | 4/2005 |

* cited by examiner

AIR COOLING EQUIPMENT FOR HEAT TREATMENT PROCESS FOR MARTENSITIC STAINLESS STEEL PIPE OR TUBE

TECHNICAL FIELD

The present invention relates to air cooling equipment used for a heat treatment process for a martensitic stainless steel pipe or tube. More particularly, it relates to air cooling equipment capable of shortening the time required for a heat treatment process by enhancing the cooling efficiency at the time when the inner surface of steel pipe or tube is air cooled in the heat treatment process. Hereinafter, "pipe or tube" is referred to as "pipe" when deemed appropriate.

BACKGROUND ART

A martensitic stainless steel pipe has conventionally been used widely for such applications as oil wells because of its excellent resistance to corrosion caused by $CO_2$. On the other hand, if all cooling operations for quenching in a heat treatment process are performed by water cooling, the martensitic stainless steel pipe is susceptible to quenching cracks because the material therefor has very excellent hardenability. Therefore, to quench the martensitic stainless steel pipe in the heat treatment process, a natural cooling method or an air cooling method in which air is sprayed toward the outer surface of steel pipe is generally adopted. The cooling method, however, requires much time to cool the pipe, and therefore the heat treatment efficiency lowers.

To eliminate the above disadvantage of low heat treatment efficiency as one purpose, for example, a method described in WO 2005/035815 (hereinafter, referred to as Patent Document 1) has been proposed. In the method described in Patent Document 1, a water cooling operation having a high cooling rate and an air cooling operation are combined by utilizing the fact that cracks are less likely to develop even if water cooling is performed in the temperature range excluding the vicinity of Ms point (a temperature at which the martensitic transformation of steel begins when cooling is performed at the quenching time). Specifically, Patent Document 1 discloses a quenching method in which after being heated to be austenitized, a steel pipe is cooled in the order of water cooling, air cooling, and water cooling.

Regarding the above-described air cooling operation, Patent Document 1 discloses an air cooling apparatus having a configuration such that the whole outer surface of steel pipe is cooled from the downside by a fan or a blower, and the inner surface of pipe end portion can be cooled by an air nozzle (paragraph 0062 of Patent Document 1).

DISCLOSURE OF THE INVENTION

Generally, the air cooling of the inner surface of steel pipe has a higher cooling efficiency than the air cooling of the outer surface of steel pipe. The reason for this is that in the air cooling of the outer surface of steel pipe, the state in which cooling is less liable to be performed is formed because high-temperature air stays on the inner surface of steel pipe, whereas in the air cooling of the inner surface of steel pipe, the time required for cooling can be shortened because the high-temperature air does not stay and therefore the heat dissipation from the inner surface of steel pipe increases, and moreover the heat on the outer surface of steel pipe is dissipated to the periphery. Therefore, in order to enhance the cooling efficiency in the air cooling of steel pipe, it is desirable to mainly air cool the inner surface of steel pipe.

However, Patent Document 1 merely discloses an air cooling apparatus having a configuration such that regarding the air cooling of the inner surface of steel pipe, the inner surface of pipe end portion can be cooled by an air nozzle as described above. In other words, in Patent Document 1, although the air cooling operation itself of the inner surface of steel pipe using a nozzle is disclosed, there is no disclosure of what configuration should be employed to enhance the cooling efficiency when the inner surface of steel pipe is air cooled using a nozzle.

The present invention has been made in view of the above-described prior art, and accordingly an object thereof is to provide air cooling equipment for a heat treatment process for a martensitic stainless steel pipe or tube, which is capable of shortening the time required for the heat treatment process by enhancing the cooling efficiency at the time when the inner surface of steel pipe or tube is air cooled in the heat treatment process.

In order to achieve the object, the present invention provides air cooling equipment for a heat treatment process for a martensitic stainless steel pipe or tube, comprising: a conveying device for intermittently conveying the steel pipe or tube in the direction substantially at right angles to the longitudinal direction of the steel pipe or tube; and an air cooling device provided with a nozzle for spraying air toward the inner surface of the steel pipe or tube, the nozzle being arranged along the longitudinal direction of the steel pipe or tube at a stop position of the steel pipe or tube intermittently conveyed by the conveying device so as to face to an end of the steel pipe or tube.

According to the air cooling equipment in accordance with the present invention, the nozzle of the air cooling device is arranged at a stop position of the steel pipe or tube intermittently conveyed by the conveying device, and air is sprayed from the nozzle toward the inner surface of steel pipe or tube. Therefore, the inner surface of steel pipe or tube can be air cooled concentratedly during the stop time of the steel pipe or tube conveyed intermittently. For this reason, the cooling efficiency can be enhanced, for example, as compared with a configuration in which the steel pipe or tube is conveyed continuously so as to pass through the nozzle installation position.

In the present invention, from the viewpoint of further enhancing the cooling efficiency of steel pipe or tube inner surface, the nozzle is preferably arranged at all of the stop positions of steel pipe or tube intermittently conveyed by the conveying device. In the air cooling equipment configured as described above, however, a large-sized blower or compressor for supplying air to the nozzle is needed, or the unit requirement of energy necessary for the heat treatment process increases, which is noneconomic.

Earnest studies conducted by the present inventor revealed that, assuming that there is no difference in temperature between the inner and outer surfaces of steel pipe or tube before air cooling, in the case where the nozzle is arranged at the stop position of steel pipe or tube, which has a high temperature, the difference between the inner surface temperature of steel pipe or tube and the temperature of air sprayed from the nozzle is large as compared with the case where the nozzle is arranged at the stop position of steel pipe or tube, which has a low temperature. Therefore, the cooling efficiency at the time when air is sprayed from the nozzle is enhanced (the decrease in inner surface temperature becomes large). However, when the steel pipe or tube moves between the nozzles (that is, when air is not sprayed from the nozzle toward the inner surface of steel pipe or tube), the quantity of heat on the outer surface and in the interior of steel pipe or tube conducts toward the inner surface, which results in the occurrence of a heat recuperating phenomenon that the inner surface temperature of steel pipe or tube rises as compared with the temperature just after the finish of air spraying. The amount of rise of the inner surface temperature due to this heat recuperation (the amount of heat recuperation) increases as the temperature difference between the inner and outer surfaces just after the finish of air spraying increases. Therefore, when the steel pipe or tube has a high temperature, the amount of heat recuperation at the time when the steel pipe or tube moves between the nozzles increases as compared with the amount of heat recuperation at the time when the steel pipe or tube has a low temperature. As the amount of heat recuperation increases, the time necessary for cooling the steel pipe or tube to a predetermined temperature by air cooling using the air spraying method lengthens. Therefore, it was found that the cooling efficiency of the whole cooling step given by the air cooling equipment in which the nozzle is arranged at the stop position of steel pipe or tube having a high temperature decreases as compared with the cooling efficiency of the whole cooling step given by the air cooling equipment in which the nozzle is arranged at the stop position of steel pipe or tube having a low temperature.

Therefore, in the case where, from the viewpoint of economy, the nozzle is limitedly arranged at some positions, not at all of the stop positions, of the steel pipe or tube, the nozzle is preferably arranged at the stop position of steel pipe or tube having a temperature as low as possible to enhance the cooling efficiency of the whole cooling step.

From the above viewpoint, preferably, the nozzle is arranged at least at a stop position of the steel pipe or tube at which the inner surface temperature is 400° C. or lower.

Also, in the present invention, from the viewpoint of further enhancing the cooling efficiency of steel pipe or tube inner surface, it is preferable that the flow rate of air sprayed from all of the arranged nozzles be increased. However, the air cooling equipment configured as described above is also noneconomic.

Therefore, in the case where the flow rate of air sprayed from all of the arranged nozzles is not increased, but the flow rate of air sprayed from some nozzles is increased from the viewpoint of economy, the flow rate of air sprayed from the nozzle arranged at the stop position of steel pipe or tube having a low temperature (that is, the stop position of steel pipe or tube having a small amount of heat recuperation) is preferably increased to enhance the cooling efficiency of the whole cooling step.

From the above viewpoint, preferably, the nozzle is arranged at a stop position of the steel pipe or tube at which the inner surface temperature is 400° C. or lower (a low-temperature stop position) and at a stop position of the steel pipe or tube at which the inner surface temperature exceeds 400° C. (a high-temperature stop position), and the flow rate of air sprayed from the nozzle arranged at the low-temperature stop position is higher than the flow rate of air sprayed from the nozzle arranged at the high-temperature stop position.

From the viewpoint of further enhancing the cooling efficiency of steel pipe or tube inner surface, the present inventor earnestly conducted studies on the optimum distance between the nozzle and the end of steel pipe or tube, and obtained a knowledge as described below. That is to say, as the distance between the nozzle and the end of steel pipe or tube shortens, the flow rate of air arriving at the steel pipe or tube inner surface of the entire air sprayed from the nozzle increases. It was found that if, in the case where the nozzle is cylindrical, the distance between the nozzle and the end of steel pipe or tube is 8.0 times or less (preferably, 2.0 times or less) the inside diameter of nozzle, the flow rate of air arriving at the steel pipe or tube inner surface of the entire air sprayed from the nozzle increases sufficiently. However, the flow rate of an atmosphere that is involved in the air sprayed from the nozzle and arrives at the steel pipe or tube inner surface together with the air sprayed from the nozzle (the involved flow rate, refer to FIGS. 3A and 3B) does not increase as the distance between the nozzle and the end of steel pipe or tube shortens. In the case where the nozzle is cylindrical, there is a tendency such that if the distance between the nozzle and the end of steel pipe or tube is less than 1.5 times the inside diameter of nozzle, the involved flow rate decreases inversely as the distance is shortened, and if the distance therebetween is less than 1.0 times the inside diameter of nozzle, the involved flow rate decreases significantly. As the result, it was found that the flow rate of air that arrives at the steel pipe or tube inner surface and is supplied for the cooling of steel pipe or tube inner surface (that is, the sum of the flow rate of air arriving at the steel pipe or tube inner surface of the entire air sprayed from the nozzle and the involved flow rate) increases when the distance between the nozzle and the end of steel pipe or tube is 1.0 to 8.0 times the inside diameter of nozzle, and increases most when the distance therebetween is 1.5 to 2.0 times.

Therefore, preferably, the nozzle is a cylindrical nozzle, and is arranged at a position at which the distance from the facing end of steel pipe or tube is 1.0 to 8.0 times the inside diameter of the nozzle.

According to the air cooling equipment for a heat treatment process for a martensitic stainless steel pipe or tube in accordance with the present invention, the cooling efficiency at the time when the inner surface of the steel pipe or tube is air cooled is enhanced, the time required for the heat treatment process is shortened, and in turn, the martensitic stainless steel pipe or tube can be manufactured with high efficiency.

BRIEF DESCRIPTION OF THE DRAWINGS

FIG. 3A is an explanatory view of the experiment, and FIG. 3B is a graph showing the relationship between the distance from the nozzle to the end of the steel pipe and the air flow rate on the inner surface of the steel pipe.

BEST MODE FOR CARRYING OUT THE INVENTION

Figure 1A:
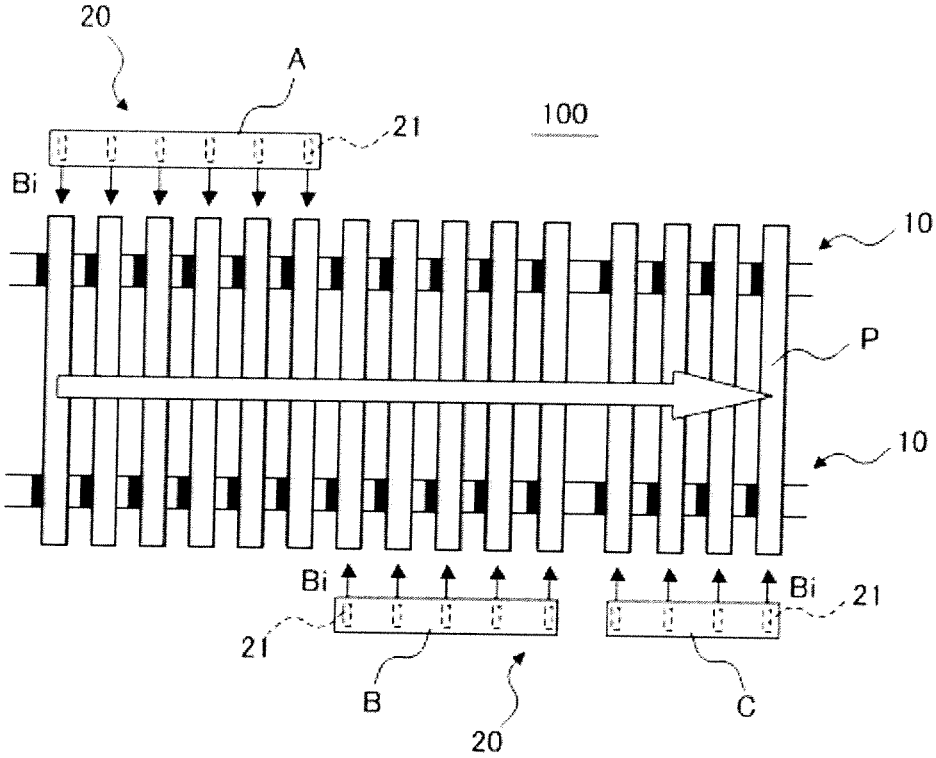
FIGS. 1A and 1B are schematic views showing a general configuration of the air cooling equipment in accordance with one embodiment of the present invention, FIG. 1A being a plan view, and FIG. 1B being a front view.

One embodiment of air cooling equipment for a heat treatment process for a martensitic stainless steel pipe in accordance with the present invention will now be described with reference to the accompanying drawings as appropriate.

First, the material for the martensitic stainless steel pipe to which the air cooling equipment in accordance with the present invention is applied is explained.

(1) C: 0.15 to 0.20 Mass % (Hereinafter, Described Simply as "%")

C (carbon) is an element necessary for obtaining a steel having a proper strength and hardness. If the C content is less than 0.15%, a predetermined strength cannot be obtained. On the other hand, if the C content exceeds 0.20%, the strength becomes too high, and it becomes difficult to control the yield ratio and hardness. Also, an increase in the amount of effective dissolved C helps delayed fracture to develop. Therefore, the C content is preferably 0.15 to 0.21%, further preferably 0.17 to 0.20%.

(2) Si: 0.05 to 1.0%

Si (silicon) is added as a deoxidizer for steel. To achieve the effect, the Si content must be 0.05% or more. On the other hand, if the Si content exceeds 1.0%, the toughness decreases. Therefore, the Si content is preferably 0.05 to 1.0%. The lower limit value of the Si content is further preferably 0.16%, still further preferably 0.20%. Also, the upper limit value thereof is further preferably 0.35%.

(3) Mn: 0.30 to 1.0%

Mn (manganese) has deoxidizing action like Si. If the Mn content is less than 0.30%, the effect is insufficient. Also, if the Mn content exceeds 1.0%, the toughness decreases. Therefore, the Mn content is preferably 0.30 to 1.0%. Considering the securing of toughness after heat treatment, the upper limit value of the Mn content is further preferably 0.6%.

(4) Cr: 10.5 to 14.0%

Cr (chromium) is a basic component for providing corrosion resistance necessary for steel. By making the Cr content 10.5% or more, the resistance to pitting and time-dependent corrosion is improved, and also the corrosion resistance in a $CO_2$ environment is increased remarkably. On the other hand, since Cr is a ferrite producing element, if the content thereof exceeds 14.0%, δ ferrite is more likely to be produced at the time of working at high temperatures, so that the hot workability is impaired. Also, the strength of steel after heat treatment is decreased. Therefore, the Cr content is preferably 10.5 to 14.0%.

(5) P: 0.020% or Less

A high content of P (phosphorous) decreases the toughness of steel. Therefore, the P content is preferably 0.020% or less.

(6) S: 0.0050% or Less

A high content of S (sulfur) decreases the toughness of steel. Also, S produces segregation, so that the quality of the inner surface of steel pipe is degraded. Therefore, the S content is preferably 0.0050% or less.

(7) Al: 0.10% or Less

Al (aluminum) exists in the steel as an impurity. If the Al content exceeds 0.10%, the toughness of steel decreases. Therefore, the Al content is preferably 0.10% or less, further preferably 0.05% or less.

(8) Mo: 2.0% or Less

The addition of Mo (molybdenum) to the steel enhances the strength of steel, and achieves an effect of improving the corrosion resistance. However, if the Mo content exceeds 2.0%, the martensitic transformation of steel is less likely to take place. Therefore, the Mo content is preferably 2.0% or less. Since Mo is an expensive alloying element, the content thereof is preferably as low as possible from the viewpoint of economy.

(9) V: 0.50% or less

The addition of V (vanadium) to the steel achieves an effect of increasing the yield ratio of steel. However, if the V content exceeds 0.50%, the toughness of steel decreases. Therefore, the V content is preferably 0.50% or less. Since V is an expensive alloying element, the content thereof is preferably 0.30% or less from the viewpoint of economy.

(10) Nb: 0.020% or Less

The addition of Nb (niobium) to the steel achieves an effect of increasing the strength of steel. However, if the Nb content exceeds 0.020%, the toughness of steel decreases. Therefore, the Nb content is preferably 0.020% or less. Since Nb is an expensive alloying element, the content thereof is preferably as low as possible from the viewpoint of economy.

(11) Ca: 0.0050% or Less

If the content of Ca (calcium) exceeds 0.0050%, the inclusions in the steel increases in amount, and the toughness of steel decreases. Therefore, the Ca content is preferably 0.0050% or less.

(12) N: 0.1000% or Less

If the content of N (nitrogen) exceeds 0.1000%, the toughness of steel decreases. Therefore, the N content is preferably 0.1000% or less. In the case where the N content is high in this range, an increase in the amount of effective dissolved N helps delayed fracture to develop. On the other hand, in the case where the N content is low, the efficiency of denitrifying step decreases, which results in hindrance to productivity. Therefore, the N content is further preferably 0.0100 to 0.0500%.

(13) Ti, B, Ni

Ti (titanium), B (boron), and Ni (nickel) can be contained in the steel as small amounts of additives or impurities. However, if the Ni content exceeds 0.2%, the corrosion resistance of steel decreases. Therefore, the Ni content is preferably 0.2% or less.

(14) Fe and Unavoidable Impurities

The material for the martensitic stainless steel pipe manufactured by the present invention contains Fe (iron) and unavoidable impurities in addition to the components of the above items (1) to (13).

Next, the air cooling equipment for a heat treatment process for the martensitic stainless steel pipe containing the above-described components is explained.

Figure 1B:
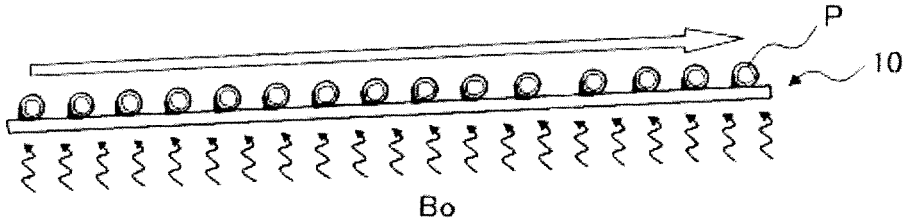

FIGS. 1A and 1B are schematic views showing a general configuration of the air cooling equipment in accordance with this embodiment, FIG. 1A being a plan view, and FIG. 1B being a front view.

As shown in FIGS. 1A and 1B, the air cooling equipment 100 in accordance with this embodiment comprises: a conveying device 10 for intermittently conveying a steel pipe P in the direction substantially at right angles to the longitudinal direction of the steel pipe P; and an air cooling device 20 provided with a nozzle 21 for spraying air Bi toward the inner surface of the steel pipe P, the nozzle 21 being arranged along the longitudinal direction of the steel pipe P at a stop position of the steel pipe P intermittently conveyed by the conveying device 10 so as to face to an end of the steel pipe P.

The conveying device 10 is a belt type or chain type conveying device, and is configured so as to convey steel pipes P in the direction substantially at right angles to the longitudinal direction of the steel pipes P while repeating movement and stop at fixed time intervals.

The air cooling device 20 includes an air source (not shown), a blower (not shown) for supplying air from the air source to the nozzles 21, the nozzles 21 for spraying the supplied air toward the inner surface of the steel pipe P. Each of the nozzles 21 of this embodiment is a cylindrical nozzle.

To effectively air cool the inner surface of the steel pipe P throughout the overall length, the air cooling device 20 in accordance with this embodiment includes, as a preferred configuration, the nozzles 21 arranged on one end side in the longitudinal direction of the steel pipe P (a nozzle group A), and the nozzles 21 arranged on the other end side in the longitudinal direction of the steel pipe P (nozzle groups B and C).

Furthermore, the air cooling equipment 100 in accordance with this embodiment is provided, as a preferred configuration, with a fan or blower (not shown) that blows air Bo onto the outer surface of the steel pipe P to cool the outer surface of the steel pipe P. By using the fan or blower, the air Bo is blown against not only the steel pipe P at the stop position but also the steel pipe P being moved. Such a preferred configuration can further enhance the cooling efficiency of the steel pipe P as compared with the case where the steel pipe P is air cooled only by the air Bi sprayed from the nozzles 21.

Figure 2:
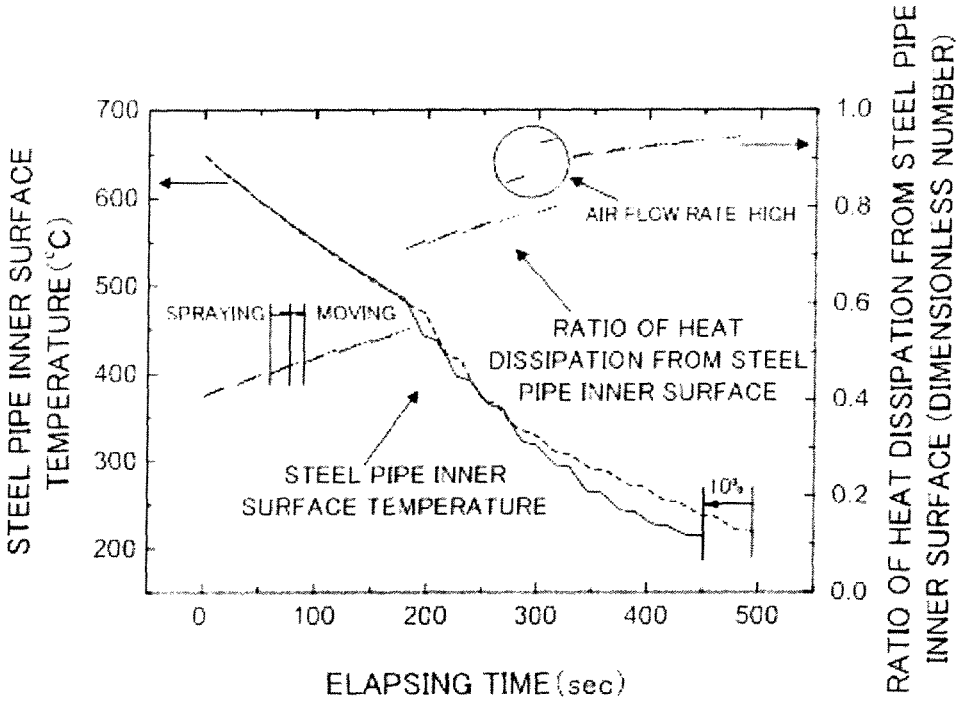
FIG. 2 is a graph showing one example of the result of numerical simulation simulating in the air cooling equipment shown in FIGS. 1A and 1B the time change of inner surface temperature of the steel pipe in a case where the flow rate of the air sprayed from the nozzle groups A to C were the same (the plot indicated by the broken line in FIG. 2) and in a case where only the flow rate of the air sprayed from the two nozzles on the upstream side in the conveyance direction of the nozzle group C was increased (the plot indicated by the solid line in FIG. 2).

FIG. 2 is a graph showing one example of the result of numerical simulation simulating in the air cooling equipment 100 shown in FIGS. 1A and 1B the time change of inner surface temperature of the steel pipe P in a case where the flow rate of the air Bi sprayed from the nozzle groups A to C were the same (case 1, the plot indicated by the broken line in FIG. 2) and in a case where only the flow rate of the air Bi sprayed from the two nozzles 21 on the upstream side in the conveyance direction of the nozzle group C was increased (case 2, the plot indicated by the solid line in FIG. 2). The abscissa of FIG. 2 represents the elapsing time from the start of air cooling, and the ordinates thereof represent the inner surface temperature of the steel pipe P and the ratio of heat dissipation from the inner surface of the steel pipe P (=the amount of heat dissipation from the inner surface of the steel pipe P/(the amount of heat dissipation from the outer surface of the steel pipe P+the amount of heat dissipation from the inner surface of the steel pipe P)).

In this numerical simulation, the outside diameter of the steel pipe P was specified to 114.3 mm, the inside diameter thereof was specified to 100.5 mm, and the length thereof was specified to 12 m. Also, the inner surface temperature (and the outer surface temperature) of the steel pipe P at the start time of air cooling in case 1 and case 2 was set at 650° C., and the elapsing time until the inner surface temperature became 220° C. was compared. In case 1, the steel pipe P was conveyed intermittently at a period of 33 seconds (movement: 13 seconds, stop: 20 seconds), and in case 2, the steel pipe P was conveyed intermittently at a period of 30 seconds (movement: 13 seconds, stop: 17 seconds).

FIG. 2 reveals that although the stop time of the steel pipe P is shorter (therefore, the period of time for which the air Bi is sprayed onto the inner surface of the steel pipe P is shorter) in case 2 than in case 1, the elapsing time from when the conveyance in the air cooling equipment 100 is finished to when the inner surface temperature decreases to about 220° C. becomes shorter (a decrease of 10%) in case 2 than in case 1.

The same numerical simulation as described above was performed in a case where only the flow rate of the air Bi sprayed from the two nozzles 21 on the upstream side in the conveyance direction of the nozzle group A was increased (case 3) and in a case where only the flow rate of the air Bi sprayed from the two nozzles 21 on the upstream side in the conveyance direction of the nozzle group B was increased (case 4). As the result, the inner surface temperature of the steel pipe P at the time when the conveyance in the air cooling equipment 100 was finished was the lowest in case 2, as shown in Table 1 below.

TABLE 1

| | Steel pipe inner surface temperature |
|---|---|
| Case 2 (nozzle group C) | 213.8° C. |
| Case 3 (nozzle group A) | 227.2° C. |
| Case 4 (nozzle group B) | 220.9° C. |

Therefore, in the case where the flow rate of the air Bi sprayed from all of the nozzles 21 arranged in the air cooling equipment 100 is not increased, but the flow rate of the air Bi sprayed from some of the nozzles 21 is increased from the viewpoint of economy, an increase in the flow rate of the air Bi sprayed from the nozzle group C arranged at the stop position of the steel pipe P having a low temperature (specifically, the inner surface temperature is 400° C. or lower) is preferable for enhancing the cooling efficiency of the whole cooling step.

In the case where similarly from the viewpoint of economy, the nozzles 21 are limitedly arranged at some positions, not at all of the stop positions, of the steel pipe P, an arrangement of the nozzles 21 at the stop position of the steel pipe P having a low temperature (specifically, the inner surface temperature is 400° C. or lower) is preferable for enhancing the cooling efficiency of the whole cooling step.

Figure 3A:
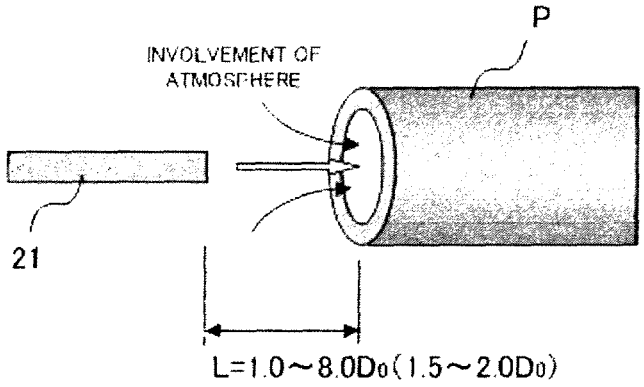
FIGS. 3A and 3B show the results of examination in which the relationship between the distance from the nozzle shown in FIGS. 1A and 1B to the end of the steel pipe and the flow rate of air on the inner surface of the steel pipe is examined experimentally.
Figure 3B:
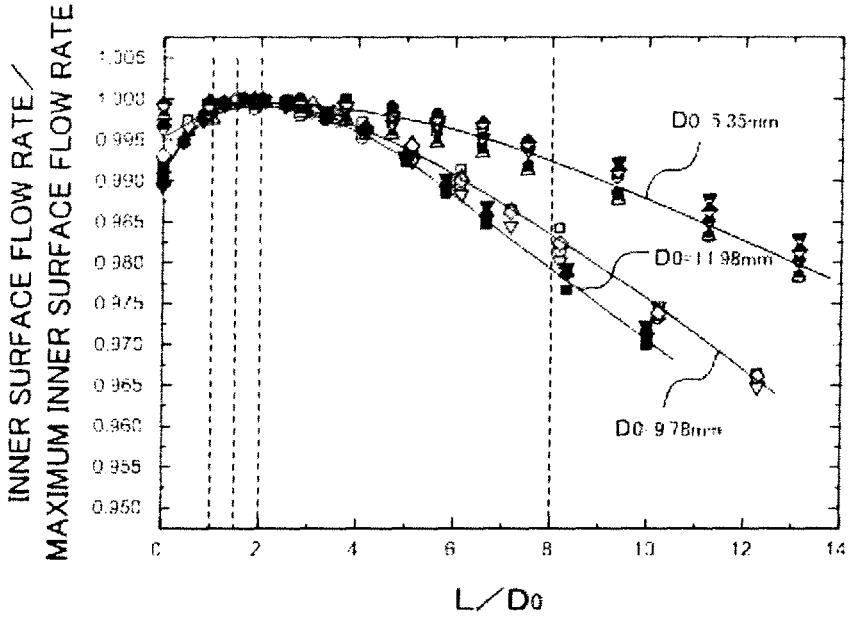

FIGS. 3A and 3B show the results of examination in which the relationship between the distance from the nozzle 21 to the end of the steel pipe P and the flow rate of air on the inner surface of the steel pipe P is examined experimentally. FIG. 3A is an explanatory view of the experiment, and FIG. 3B is a graph showing the relationship between the distance from the nozzle 21 to the end of the steel pipe P and the air flow rate on the inner surface of the steel pipe P. The abscissa of FIG. 3B represents the ratio of distance L between the nozzle 21 and the end of the steel pipe P to inside diameter $D_0$ of nozzle, and the ordinate thereof represents the ratio of air flow rate on the inner surface of the steel pipe P to the maximum air flow rate on the inner surface of the steel pipe P.

In this experiment, the steel pipe P having an inside diameter of 54.6 mm and three kinds of nozzles 21 having an inside diameter $D_0$ of 11.98 mm, 9.78 mm, and 5.35 mm were used, and the distance from the nozzle 21 to the end (an end on the side facing to the nozzle 21) of the steel pipe P was changed. The air flow rate on the inner surface of the steel pipe P was measured by using a flow meter disposed in an end (an end on the side opposite to the side facing to the nozzle 21) of the steel pipe P.

As shown in FIGS. 3A and 3B, it was found that for all of the nozzles 21, when $L/D_0$ is in the range of 1.0 to 8.0, the air flow rate on the inner surface of the steel pipe P is 97% or more of the maximum air flow rate, and when $L/D_0$ is in the range of 1.5 to 2.0, the air flow rate on the inner surface of the steel pipe P becomes at a maximum. Therefore, from the viewpoint of further enhancing the cooling efficiency of the inner surface of the steel pipe P, the nozzle 21 is preferably arranged at a position at which the distance L from the facing end of the steel pipe P is 1.0 to 8.0 times the inside diameter $D_0$ of the nozzle 21, further preferably arranged at a position at which the distance L is 1.5 to 2.0 times the inside diameter $D_0$.

The invention claimed is:

1. An air cooling equipment for a heat treatment process for a martensitic stainless steel pipe or tube, comprising:

a conveying device for intermittently conveying the steel pipe or tube in a direction substantially at right angles to a longitudinal direction of the steel pipe or tube; and an air cooling device provided with a first group of nozzles and a second group of nozzles for spraying air through an inner surface of the steel pipe or tube, the first group of nozzles and the second group of nozzles being arranged along the longitudinal direction of the steel pipe or tube at first stop positions and second stop positions of the steel pipe or tube intermittently conveyed by the conveying device so as to face to an end of the steel pipe or tube, wherein the first group of nozzles is arranged at the first stop positions of the steel pipe or tube at which the inner surface temperature is 400° C. or lower, and the second group of nozzles is arranged at the second stop positions of the steel pipe or tube at which the inner surface temperature exceeds 400° C., and a volumetric flow rate of the air sprayed from the first group of nozzles arranged at the first stop positions is higher than the volumetric flow rate of the air sprayed from the second group of nozzles arranged at the second stop positions.

2. The air cooling equipment for the heat treatment process for the martensitic stainless steel pipe or tube according to claim 1, wherein the first and the second groups of nozzles are cylindrical nozzles, and are arranged at positions at which the distance from the facing end of steel pipe or tube is 1.0 to 8.0 times the inside diameter of the first and the second groups of nozzles.

* * * * *

UNITED STATES PATENT AND TRADEMARK OFFICE

CERTIFICATE OF CORRECTION

PATENT NO. : 9,181,610 B2
APPLICATION NO. : 12/934241
DATED : November 10, 2015
INVENTOR(S) : Nobuyuki Mori et al.

It is certified that error appears in the above-identified patent and that said Letters Patent is hereby corrected as shown below:

On the Title Page:

Item (57), line 6, “treatment ent” should be -- treatment --.

In the Claims:

At Column 9, line 12, “lower,” should be -- lower --.

Signed and Sealed this
Twenty-ninth Day of March, 2016

Michelle K. Lee

Michelle K. Lee
*Director of the United States Patent and Trademark Office*